US011788480B2

(12) United States Patent
Rollinger et al.

(10) Patent No.: US 11,788,480 B2
(45) Date of Patent: Oct. 17, 2023

(54) SYSTEM AND METHOD FOR DEACTIVATING ENGINE CYLINDERS

(71) Applicant: Ford Global Technologies, LLC, Dearborn, MI (US)

(72) Inventors: John Rollinger, Troy, MI (US); Adam Krach, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/658,218

(22) Filed: Apr. 6, 2022

(65) Prior Publication Data

US 2022/0228535 A1 Jul. 21, 2022

Related U.S. Application Data

(62) Division of application No. 16/409,060, filed on May 10, 2019, now Pat. No. 11,352,962.

(51) Int. Cl.

*F02D 13/02* (2006.01)
*F02D 41/00* (2006.01)
*F02D 41/30* (2006.01)

(52) U.S. Cl.

CPC ..... *F02D 13/0257* (2013.01); *F02D 41/0087* (2013.01); *F02D 41/30* (2013.01)

(58) Field of Classification Search

CPC .. F02D 13/0257; F02D 13/06; F02D 13/0203; F02D 13/0215; F02D 17/02; F02D 37/02; F02D 41/0087; F02D 41/30; F02D 41/3058; F02D 2041/0012

See application file for complete search history.

(56) References Cited

U.S. PATENT DOCUMENTS

| | | | | |
|---|---|---|---|---|
| 6,273,039 | B1 | 8/2001 | Church | |
| 6,321,704 | B1 | 11/2001 | Church et al. | |
| 7,167,792 | B1 * | 1/2007 | Kolmanovsky | F02M 31/10 123/90.15 |
| 7,249,583 | B2 | 7/2007 | Bidner et al. | |
| 7,458,345 | B2 | 12/2008 | Winstead et al. | |
| 9,605,601 | B2 | 3/2017 | Leone et al. | |
| 9,835,101 | B2 | 12/2017 | Leone et al. | |
| 10,081,360 | B2 | 9/2018 | Hu et al. | |
| 10,202,910 | B2 | 2/2019 | Leone et al. | |
| 10,207,699 | B2 | 2/2019 | Namuduri et al. | |
| 2005/0131618 | A1 * | 6/2005 | Megli | F02D 13/0257 701/101 |
| 2014/0303873 | A1 | 10/2014 | Glugla et al. | |
| 2016/0024981 | A1 * | 1/2016 | Parsels | F01L 1/18 123/90.11 |
| 2016/0108825 | A1 | 4/2016 | Rumpsa | |
| 2017/0356355 | A1 * | 12/2017 | Rollinger | F01L 13/0005 |
| 2017/0356372 | A1 * | 12/2017 | Richards | F02D 41/0007 |
| 2017/0356381 | A1 * | 12/2017 | Richards | F02D 41/3094 |
| 2018/0266347 | A1 * | 9/2018 | Fuschetto | F02D 41/0085 |

* cited by examiner

*Primary Examiner* — Grant Moubry
*Assistant Examiner* — James G Moubry
(74) *Attorney, Agent, or Firm* — Vincent Mastrogiacomo; McCoy Russell LLP

(57) ABSTRACT

Systems and methods for determining which of an intake valve and an exhaust valve is to be deactivated first when an engine is operated in a variable displacement mode. In one example, an exhaust valve of the cylinder is deactivated before an intake valve of the cylinder when the engine is operated in a static variable displacement operating mode.

7 Claims, 5 Drawing Sheets

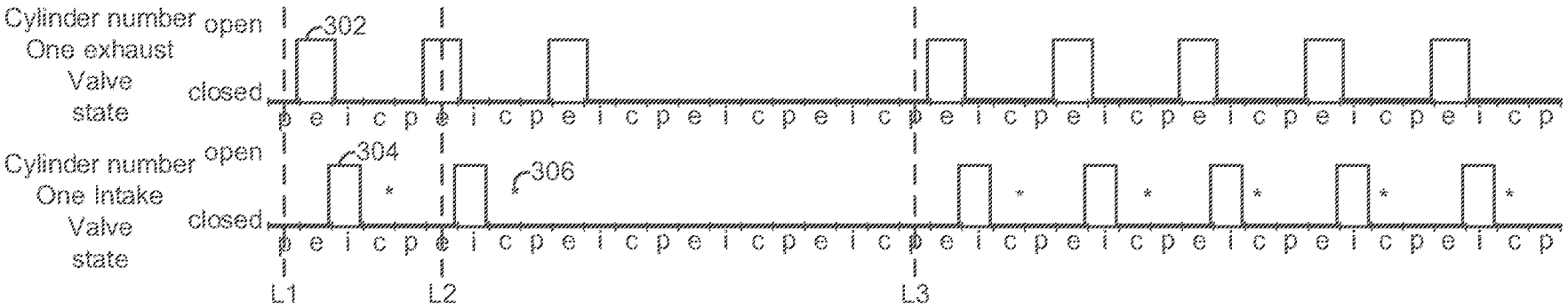
Cylinder number
One exhaust
Valve state
open
closed
Cylinder number
One Intake
Valve state
open
closed
302
304
306
L1
L2
L3
p e i c p e i c p e i c

SYSTEM AND METHOD FOR DEACTIVATING ENGINE CYLINDERS

CROSS REFERENCE TO RELATED APPLICATION

The present application is a divisional of U.S. Non-Provisional patent application Ser. No. 16/409,060, entitled "SYSTEM AND METHOD FOR DEACTIVATING ENGINE CYLINDERS", and filed on May 10, 2019. The entire contents of the above-listed application are hereby incorporated by reference for all purposes.

FIELD

The present description relates to a system and methods for selectively activating and deactivating cylinders of an engine to conserve fuel while meeting engine torque demands. The system and methods vary which cylinders of an engine fire from one engine cycle to the next engine cycle.

BACKGROUND AND SUMMARY

An engine may operate in a variable displacement mode to reduce fuel consumption. The engine may operate in a static variable displacement mode where a group of same cylinders that is less than the total number of engine cylinders are activated. For example, cylinder numbers 1, 7, 6, and 4 of an eight cylinder engine may be activated each engine cycle for a plurality of engine cycles. On the other hand, the engine may also operate in a rolling variable displacement mode where a group of different engine cylinders that is less than the total number of engine cylinders may be activated each engine cycle. For example, cylinders 1, 3, 2, 6, 4, and 8 of an eight cylinder engine may be activated in one engine cycle immediately followed by cylinders 3, 7, 6, 5, 8 being activated in a next engine cycle, then cylinders 1, 7, 2, 5, and 4 may be activated next before the cycle repeats. However, even though deactivating some cylinders may improve engine efficiency, engine efficiency may still be less than desired due to engine pumping losses.

The inventors herein have recognized the above-mentioned issues and have developed an engine control method, comprising: deactivating an exhaust valve of a cylinder of an engine during a cylinder cycle before deactivating an intake valve of the cylinder during the cylinder cycle during a first condition; and deactivating the intake valve of the cylinder during the cylinder cycle before deactivating the exhaust valve of the cylinder during the cylinder cycle during a second condition.

By deactivating an intake valve of a cylinder before deactivating an exhaust valve of the cylinder, it may be possible to reduce engine pumping losses so that engine efficiency may be improved while operating an engine in a variable displacement mode. Further, by deactivating an exhaust valve of the cylinder before deactivating an intake valve of the cylinder during the cycle of the cylinder, it may be possible to reduce engine oil consumption. In particular, the inventors have determined that engine pumping losses may be reduced by lowering in cylinder pressure when an intake valve of a cylinder is deactivated (e.g., held in a fully closed operating state for one or more cylinder cycles) before an exhaust valve of the cylinder is deactivated during a cycle of the cylinder, thereby reducing fuel consumption. Further, the inventors have determined that engine oil consumption may be reduced by increasing in cylinder pressure when the exhaust valve of the cylinder is deactivated before the intake valve is deactivated during a cycle of the cylinder. Thus, by selectively changing an order of valve deactivation to deactivate a cylinder, different engine operating objectives may be achieved.

The present description may provide several advantages. In particular, the approach may improve engine efficiency when a cylinder may be deactivated for a short period of time. Further, the approach may reduce engine oil consumption during conditions when a cylinder may be deactivated for an extended period of time. In addition, the approach may be performed in cooperation with a selected vehicle operating mode.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where:

FIG. 3 is plot of a first example cylinder deactivating and activating sequence;

FIG. 4 is a plot of a second example cylinder deactivating and activing sequence;

DETAILED DESCRIPTION

The present description is related to improving engine operating efficiency and engine oil consumption when operating an engine that may be operated in a plurality of variable displacement modes. The engine may be of the type shown in FIGS. 1-2B. The engine's intake and exhaust valves may be deactivated and activated according to the sequences shown in FIGS. 3 and 4. The engine may be operated according to the method of FIG. 5. Plots in FIG. 6 show how engine pumping may be affected by a selected cylinder deactivating sequences.

Figure 1:
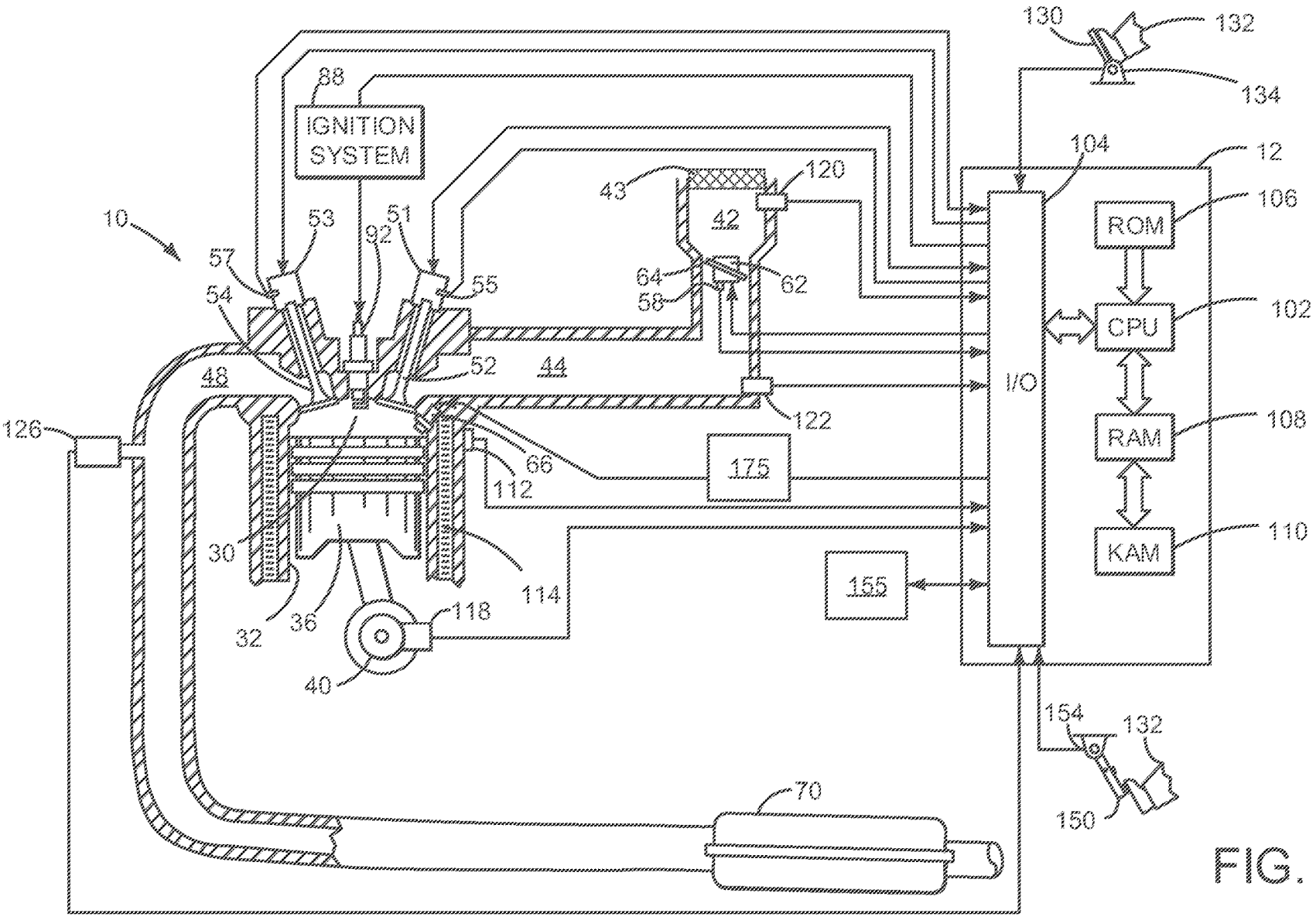
FIG. 1 is a schematic diagram of an engine.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40.

Combustion chamber 30 is shown communicating with intake manifold 44 and exhaust manifold 48 via respective intake valve 52 and exhaust valve 54. Each intake and exhaust valve may be operated by a variable intake valve operator 51 and a variable exhaust valve operator 53, which may be actuated mechanically, electrically, hydraulically, or by a combination of the same. For example, the valve actuators may be in a roller finger follower configuration or of the type described in U.S. Patent Publication 2014/0303873 and U.S. Pat. Nos. 6,321,704; 6,273,039; and 7,458,345, which are hereby fully incorporated for all intents and purposes. Intake valve operator 51 and an exhaust valve operator may open intake 52 and exhaust 54 valves synchronously or asynchronously with crankshaft 40. The position of intake valve 52 may be determined by intake valve position sensor 55. The position of exhaust valve 54 may be determined by exhaust valve position sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal from controller 12. Fuel is delivered to fuel injector 66 by a fuel system 175. In addition, intake manifold 44 is shown communicating with optional electronic throttle 62 (e.g., a butterfly valve) which adjusts a position of throttle plate 64 to control air flow from air filter 43 and air intake 42 to intake manifold 44. Throttle 62 regulates air flow from air filter 43 in engine air intake 42 to intake manifold 44. In one example, a high pressure, dual stage, fuel system may be used to generate higher fuel pressures. In some examples, throttle 62 and throttle plate 64 may be positioned between intake valve 52 and intake manifold 44 such that throttle 62 is a port throttle.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by human driver 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; brake pedal position from brake pedal position sensor 154 when human driver 132 applies brake pedal 150; and a measurement of throttle position from sensor 58. Barometric pressure may also be sensed (sensor not shown) for processing by controller 12. Controller 12 may also receive input from and provide output to human/machine interface 115 (e.g., a touch display panel, pushbuttons, or other known human/machine interface). For example, human 132 may request that engine 10 be operated in an economy mode or a performance mode via human/machine interface 115. Alternatively, or in addition, controller 12 may provide vehicle status information, such as diagnostic indications and codes, human 132 via human/machine interface 155. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Figure 2A:
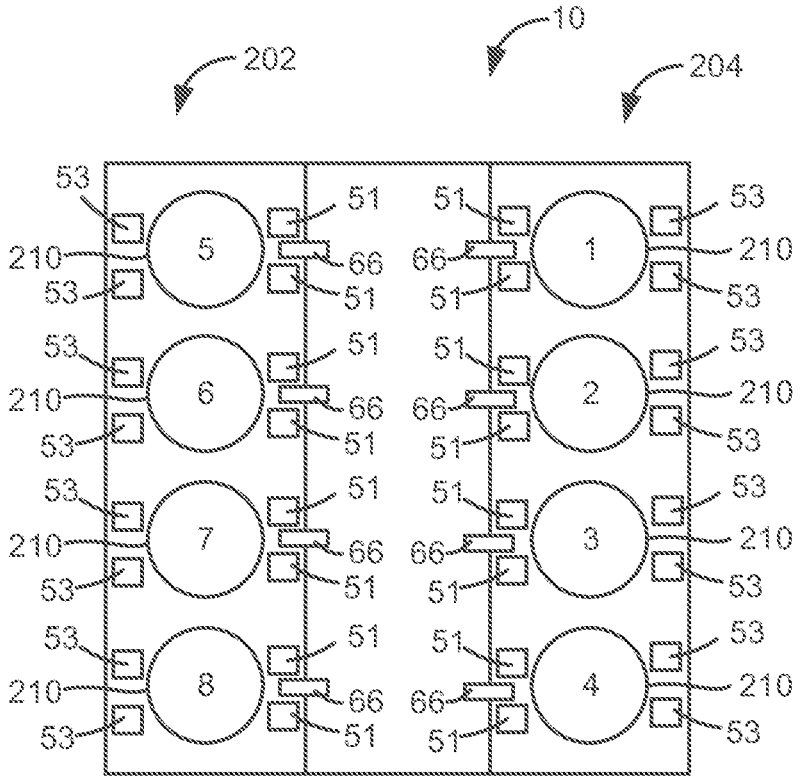
FIG. 2A is a schematic diagram of an eight cylinder engine with two cylinder banks.

Referring now to FIG. 2A, an example multi-cylinder engine that includes two cylinder banks is shown. The engine includes cylinders and associated components as shown in FIG. 1. Engine 10 includes eight cylinders 210. Each of the eight cylinders is numbered and the numbers of the cylinders are included within the cylinders. Fuel injectors 66 selectively supply fuel to each of the cylinders that are activated (e.g., combusting fuel during a cycle of the engine). Cylinders 1-8 may be selectively deactivated to improve engine fuel economy when less than the engine's full torque capacity is requested. For example, cylinders 2, 3, 5, and 8 (e.g., a fixed pattern of deactivated cylinders) may be deactivated during an engine cycle (e.g., two revolutions for a four stroke engine) and may be deactivated for a plurality of engine cycles while engine speed and load are constant or vary slightly. During a different engine cycle, a second fixed pattern of cylinders 1, 4, 6, and 7 may be deactivated for a plurality of engine cycles while engine speed and load are constant or vary slightly. Such cylinder deactivation modes may be referred to as static cylinder deactivation modes.

In addition, the engine cylinders may be operating such that other patterns of cylinders may be selectively deactivated based on vehicle operating conditions. Additionally, engine cylinders may be deactivated such that a fixed pattern of cylinders is not deactivated over a plurality of engine cycles. Rather, cylinders that are deactivated may change from one engine cycle to the next engine cycle. For example, cylinders 1, 3, 2, 6, 4, and 8 may fire and cylinders 5 and 7 may be deactivated in an engine cycle; cylinders 3, 7, 6, 5, and 8 may fire and cylinders 1, 2, and 6 may be deactivated in the next engine cycle; cylinders 1, 7, 2, 5, and 4 may fire and cylinders 2, 3 and 8 may be deactivated in a next engine cycle; then the activated cylinder and deactivated cylinder pattern may repeat. Such cylinder deactivation modes may be referred to as rolling cylinder deactivation modes.

Each cylinder includes variable intake valve operators 51 and variable exhaust valve operators 53. An engine cylinder may be deactivated by its variable intake valve operators 51 and variable exhaust valve operators holding intake and exhaust valves of the cylinder closed during an entire cycle of the cylinder. An engine cylinder may be activated by its variable intake valve operators 51 and variable exhaust valve operators 53 opening and closing intake and exhaust valves of the cylinder during a cycle of the cylinder. Engine 10 includes a first cylinder bank 204, which includes four cylinders 1, 2, 3, and 4. Engine 10 also includes a second cylinder bank 202, which includes four cylinders 5, 6, 7, and 8. Cylinders of each bank may be active or deactivated during a cycle of the engine.

Figure 2B:
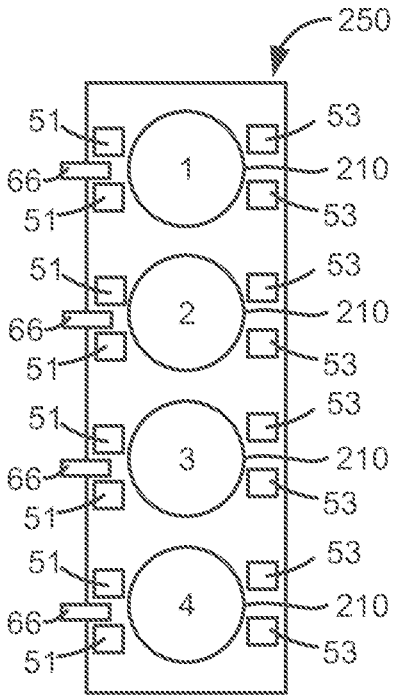
FIG. 2B is a schematic diagram of a four cylinder engine with a single cylinder bank.

Referring now to FIG. 2B, an example multi-cylinder engine that includes one cylinder banks is shown. The engine includes cylinders and associated components as shown in FIG. 1. Engine 10 includes four cylinders 210. Each of the four cylinders is numbered and the numbers of the cylinders are included within the cylinders. Fuel injectors 66 selectively supply fuel to each of the cylinders that are activated (e.g., combusting fuel during a cycle of the engine with intake and exhaust valves opening and closing during a cycle of the cylinder that is active). Cylinders 1-4 may be selectively deactivated (e.g., not combusting fuel during a cycle of the engine with intake and exhaust valves held closed over an entire cycle of the cylinder being deactivated) to improve engine fuel economy when less than the engine's full torque capacity is requested. For example, cylinders 2 and 3 (e.g., a fixed or static pattern of deactivated cylinders) may be deactivated during a plurality of engine cycles (e.g., two revolutions for a four stroke engine). During a different engine cycle, a second fixed pattern cylinders 1 and 4 may be deactivated over a plurality of engine cycles. Further, other patterns of cylinders may be selectively deactivated based on vehicle operating conditions. Additionally, engine cylinders may be deactivated such that a fixed pattern of cylinders is not deactivated over a plurality of engine cycles. Rather, cylinders that are deactivated may change from one engine cycle to the next engine cycle. In this way, the deactivated engine cylinders may rotate or change from one engine cycle to the next engine cycle.

Engine 10 includes a single cylinder bank 250, which includes four cylinders 1-4. Cylinders of the single bank may be active or deactivated during a cycle of the engine. Each cylinder includes variable intake valve operators 51 and variable exhaust valve operators 53. An engine cylinder may be deactivated by its variable intake valve operators 51 and variable exhaust valve operators holding intake and exhaust valves of the cylinder closed during a cycle of the cylinder. An engine cylinder may be activated by its variable intake valve operators 51 and variable exhaust valve operators 53 opening and closing intake and exhaust valves of the cylinder during a cycle of the cylinder.

Additionally, six cylinder engines may also be configured similarly to provide static and rolling variable displacement cylinder modes. The six cylinder engines may be of V or inline configurations.

The system of FIGS. 1-2B provides for an engine system, comprising: an engine including one or more cylinder deactivating mechanisms; a controller including executable instructions stored in non-transitory memory to deactivate a first valve of a cylinder of the engine first in a cylinder cycle in response to a request to operate the engine in a static variable displacement mode, and deactivate a second valve of the cylinder of the engine first in the cylinder cycle in response to a request to operate the engine in a rolling variable displacement mode. The engine system includes where the first valve is an exhaust valve. The engine system includes where the second valve is an intake valve. The engine system further comprises additional instructions to deliver spark to the cylinder when the exhaust valve is deactivated first in the cylinder cycle. The engine system further comprises additional instructions to not deliver spark to the cylinder when the exhaust valve is not deactivated first in the cylinder cycle.

Referring now to FIG. 3, plots showing an example cylinder deactivation and activation sequence are shown. The two plots are aligned in time and occur at the same time. The vertical dotted lines identified by labels L1-L3 indicate times of interest in the sequence. The sequence may be provided by the system of FIGS. 1-2B including the method of FIG. 5 stored as executable instructions in non-transitory memory.

The first plot from the top of FIG. 3 is a plot of exhaust valve operating state for cylinder number one versus cylinder strokes of cylinder number one. The plot starts on the left side of the page and moves to the right side of the page. The power strokes of cylinder number one are indicated by "p." The exhaust strokes of cylinder number one are indicated by "e." The intake strokes of cylinder number one are indicated by "i." The compression strokes of cylinder number one are indicated by "c." Each stroke is separated from the other strokes via a small vertical line. The operating state of the exhaust valve of cylinder number one is indicated by trace 302. The exhaust valve of cylinder number one is fully closed when trace 302 is near the horizontal axis. The exhaust valve of cylinder number one is fully open when trace 302 is at a higher level near the "open" label that is positioned along the vertical axis.

The second plot from the top of FIG. 3 is a plot of intake valve operating state for cylinder number one versus cylinder strokes of cylinder number one. The plot starts on the left side of the page and moves to the right side of the page. The power strokes of cylinder number one are indicated by "p." The exhaust strokes of cylinder number one are indicated by "e." The intake strokes of cylinder number one are indicated by "i." The compression strokes of cylinder number one are indicated by "c." Each stroke is separated from the other strokes via a small vertical line. The operating state of the intake valve of cylinder number one is indicated by trace 304. The intake valve of cylinder number one is fully closed when trace 304 is near the horizontal axis. The intake valve of cylinder number one is fully open when trace 304 is at a higher level near the "open" label that is positioned along the vertical axis. Spark ignition events are indicated by "*" marks as shown at 306.

The cylinder deactivation sequence of FIG. 3 shows cylinder number one being deactivated by first deactivating the intake valve of cylinder number one and then deactivating the exhaust valve in the same engine cycle. By deactivating the intake valve before the exhaust valve when cylinder one is being deactivated, pressure in cylinder number one may be reduced after the intake and exhaust valves of cylinder number one are deactivated so that engine pumping work may be lowered, thereby increasing engine fuel efficiency.

At engine position L1, the engine is operating with cylinder number one being activated (e.g., combusting fuel while the engine crankshaft is rotating). Shortly thereafter, the exhaust valve of cylinder number one opens and closes followed by the intake valve of cylinder number one opening and closing.

At engine position L2, a request to deactivate cylinder number one is generated. The request may be in response to a change in engine speed or engine load. Additionally, the request may be made due to a change in variable engine displacement cylinder mode. The intake valve of cylinder number one opens shortly after engine location L2 to provide a last combustion event (e.g., combustion of inducted air and injected fuel) in the first engine cycle (e.g., two engine revolutions for a four stroke engine) following the request to deactivate cylinder number one. The intake valve of cylinder number one is closed after it has opened and then the intake valve of cylinder number one is deactivated in a closed state so that contents in the engine cylinder may be trapped. The air that was inducted into cylinder number one during the intake stroke of cylinder number one is combusted at 306. The exhaust valve opens at the end of the next subsequent power stroke to release the combustion gases, thereby lowering the pressure in cylinder number one. The exhaust valve of cylinder number one closes after it is opened and then the exhaust valve of cylinder number one is deactivated in a closed state. Cylinder number one is then deactivated without combusting air and fuel for three engine cycles, but the exhaust valve of cylinder number one is deactivated for two cylinder cycles.

At engine position L3, a request to activate (e.g., induct air and combust air and fuel in the cylinder) cylinder number one is generated. The request to activate cylinder number one may be due to a change in engine speed or engine load. Further, the request to reactivate cylinder number one may be generated in response to a change in variable displacement engine cylinder mode. The exhaust valve of cylinder number one is reactivated and it opens shortly after engine position L3 so that exhaust gas scavenging from the exhaust manifold may be realized. The exhaust valve of cylinder number one opens and closes in response to the request to reactivate cylinder number one. The intake valve of cylinder number one is activated shortly after the exhaust valve of cylinder number one is activated. Cylinder number one resumes activated status after its intake and exhaust valves are reactivated.

In this way, an intake valve of a cylinder may be deactivated before an exhaust valve of the cylinder is deactivated so that a low pressure is provided in the cylinder. The lower pressure in the cylinder may reduce engine pumping work, thereby increasing engine fuel economy.

Referring now to FIG. 4, plots showing an example cylinder deactivation and activation sequence are shown. The two plots are aligned in time and occur at the same time. The vertical dotted lines identified by labels L10-L12 indicate times of interest in the sequence. The sequence may be provided by the system of FIGS. 1-2B including the method of FIG. 5 stored as executable instructions in non-transitory memory.

The first plot from the top of FIG. 4 is a plot of exhaust valve operating state for cylinder number one versus cylinder strokes of cylinder number one. The plot starts on the left side of the page and moves to the right side of the page. The power strokes of cylinder number one are indicated by "p." The exhaust strokes of cylinder number one are indicated by "e." The intake strokes of cylinder number one are indicated by "i." The compression strokes of cylinder number one are indicated by "c." Each stroke is separated from the other strokes via a small vertical line. The operating state of the exhaust valve of cylinder number one is indicated by trace 402. The exhaust valve of cylinder number one is fully closed when trace 402 is near the horizontal axis. The exhaust valve of cylinder number one is fully open when trace 402 is at a higher level near the "open" label that is positioned along the vertical axis.

The second plot from the top of FIG. 4 is a plot of intake valve operating state for cylinder number one versus cylinder strokes of cylinder number one. The plot starts on the left side of the page and moves to the right side of the page. The power strokes of cylinder number one are indicated by "p." The exhaust strokes of cylinder number one are indicated by "e." The intake strokes of cylinder number one are indicated by "i." The compression strokes of cylinder number one are indicated by "c." Each stroke is separated from the other strokes via a small vertical line. The operating state of the intake valve of cylinder number one is indicated by trace 304. The intake valve of cylinder number one is fully closed when trace 404 is near the horizontal axis. The intake valve of cylinder number one is fully open when trace 404 is at a higher level near the "open" label that is positioned along the vertical axis. Spark ignition events are indicated by "*" marks as shown at 406.

The cylinder deactivation sequence of FIG. 4 shows cylinder number one being deactivated by first deactivating the exhaust valve of cylinder number one and then deactivating the intake valve in the same engine cycle. By deactivating the exhaust valve before the intake valve when cylinder one is being deactivated, pressure in cylinder number one may be preserved at a higher level after the intake and exhaust valves of cylinder number one are deactivated so that pressure in the cylinder may be maintained. Maintaining pressure in the cylinder may reduce engine oil consumption since pressure in the engine cylinder may help to keep engine oil outside of the combustion chamber.

At engine position L10, the engine is operating with cylinder number one being activated (e.g., combusting fuel while the engine crankshaft is rotating). Shortly thereafter, the exhaust valve of cylinder number one opens and closes followed by the intake valve of cylinder number one opening and closing.

At engine position L11, a request to deactivate cylinder number one is generated. The request may be in response to a change in engine speed or engine load. Additionally, the request may be made due to a change in cylinder mode. The exhaust valve is open at engine position L11 and it closes shortly thereafter where the exhaust valve is deactivated in a closed position. The intake valve of cylinder number one opens shortly after engine location L11 to provide a last combustion event (e.g., combustion of inducted air and injected fuel) in the first engine cycle (e.g., two engine revolutions for a four stroke engine) following the request to deactivate cylinder number one. The intake valve of cylinder number one is closed after it has opened and then the intake valve of cylinder number one is deactivated in a closed state so that contents in the engine cylinder may be trapped. The air that was inducted into cylinder number one during the intake stroke of cylinder number one is combusted at 406. The exhaust valve remains closed at the end of the next subsequent power stroke so that the combustion gases are trapped in cylinder number one, thereby maintaining the higher pressure (e.g., pressure that is higher than in the cylinder after the exhaust valve opens after engine position L2 in FIG. 3) in cylinder number one. Cylinder number one is deactivated until engine position L12 without combusting air and fuel for six engine cycles.

At engine position L12, a request to activate (e.g., induct air and combust air and fuel in the cylinder) cylinder number one is generated. The request to activate cylinder number one may be due to a change in engine speed or engine load. Further, the request to reactivate cylinder number one may be generated in response to a change in engine cylinder mode. The exhaust valve of cylinder number one is reactivated and it opens shortly after engine position L12 so that exhaust gas scavenging from the exhaust manifold may be realized. The exhaust valve of cylinder number one opens and closes in response to the request to reactivate cylinder number one. The intake valve of cylinder number one is activated shortly after the exhaust valve of cylinder number one is activated. Cylinder number one resumes activated status after its intake and exhaust valves are reactivated.

In this way, an exhaust valve of a cylinder may be deactivated before an intake valve of the cylinder is deactivated so that a higher pressure is provided in the cylinder. The higher pressure in the cylinder may reduce engine oil consumption and engine emissions.

Figure 5:
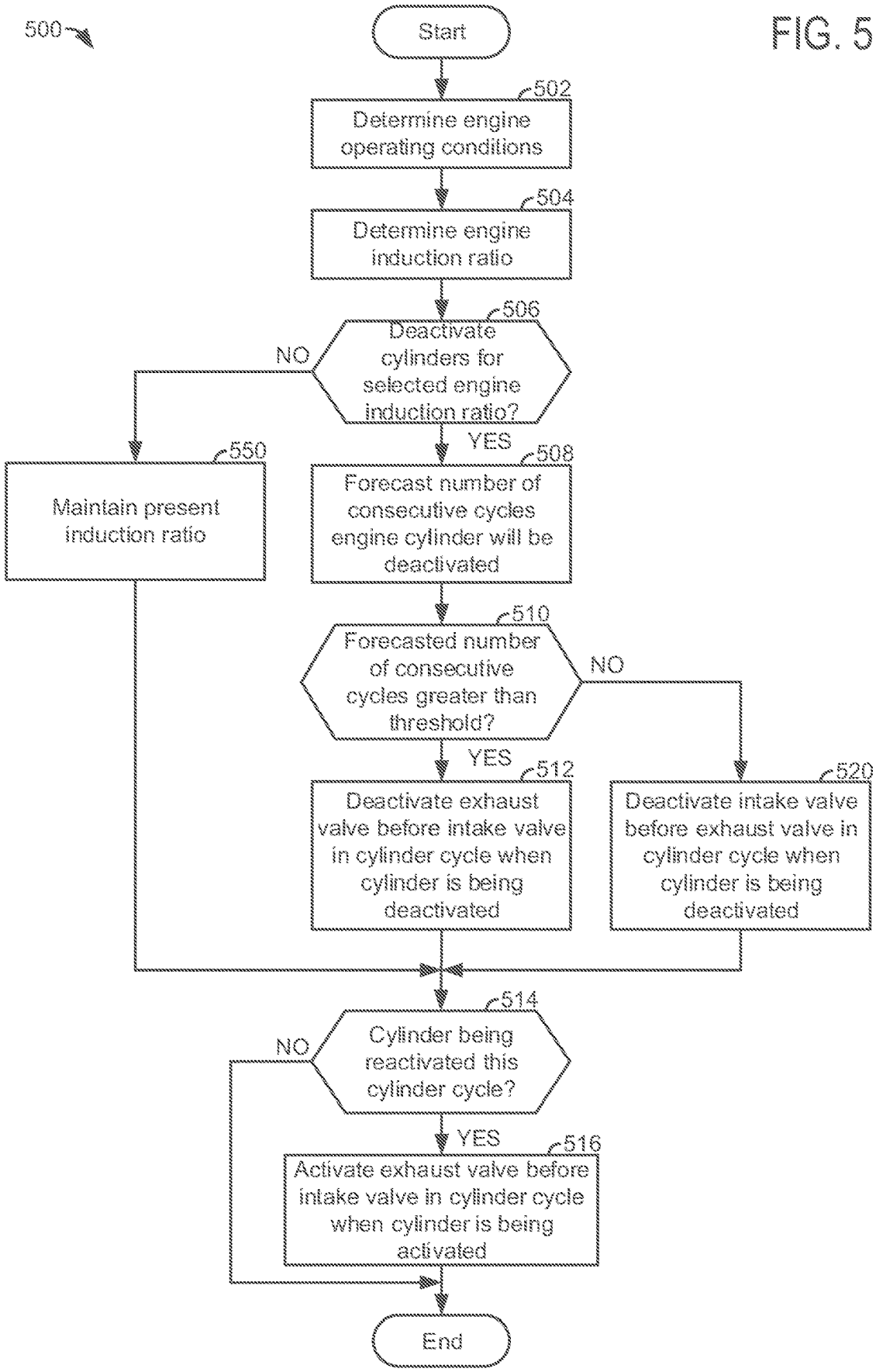
FIG. 5 shows a flow chart of an example method for operating an engine.
Figure 6:
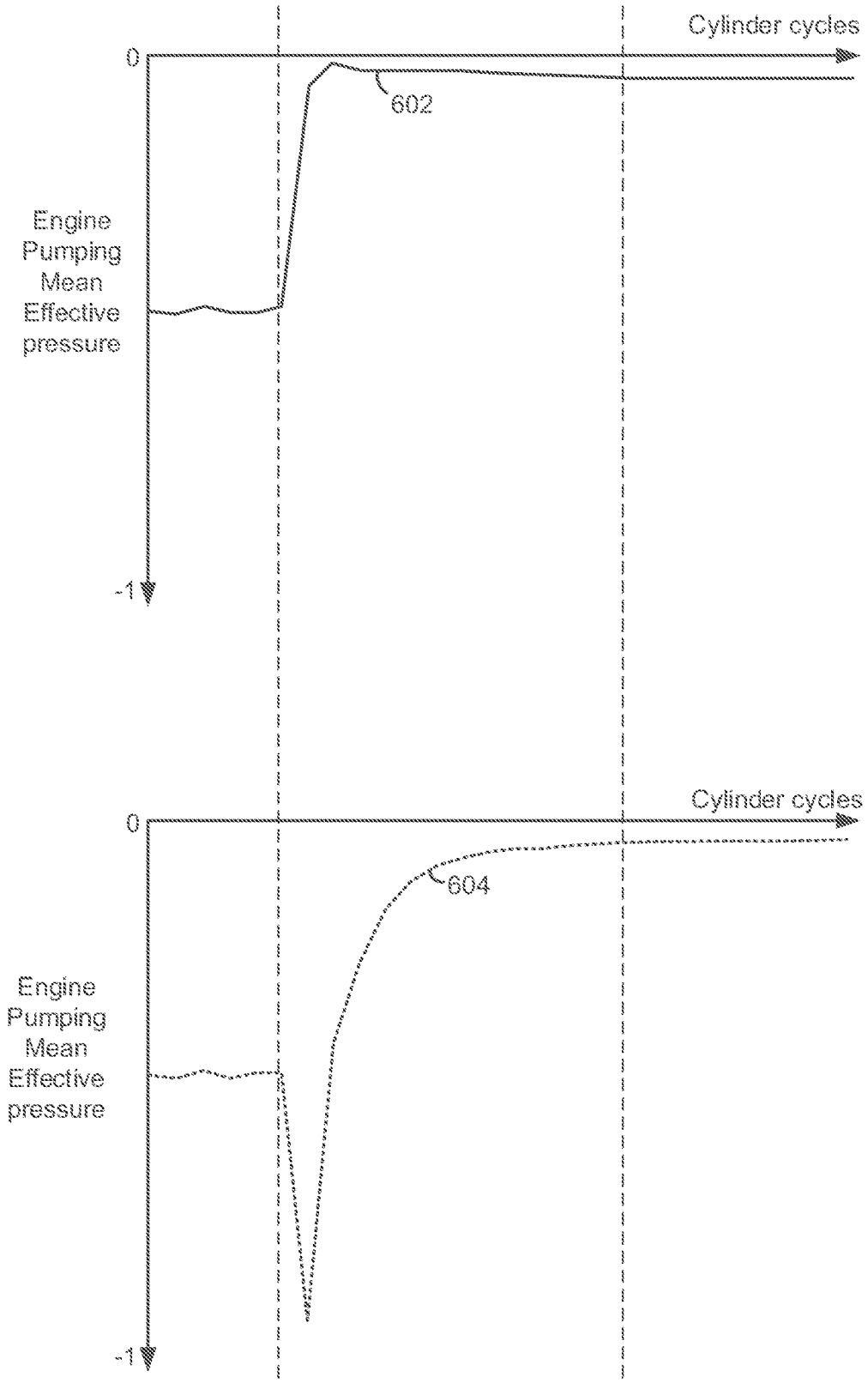
FIG. 6 shows engine pumping pressures for two different cylinder deactivation sequences.

Referring now to FIG. 5, a flow chart describing a method for transitioning between variable displacement engine cylinder modes is shown. The method of FIG. 5 may be incorporated into and may cooperate with the system of FIGS. 1-2B. Further, at least portions of the method of FIG. 5 may be incorporated as executable instructions stored in non-transitory memory while other portions of the method may be performed via a controller transforming operating states of devices and actuators in the physical world.

At 502, method 500 determines engine operating conditions. Engine operating conditions may include, but are not limited to engine speed, driver demand torque, engine temperature, barometric pressure, vehicle speed, ambient humidity, and ambient temperature. In one example, driver demand torque may be determined via indexing or referencing a table of empirically determined driver demand torque values. The table may be referenced via accelerator pedal position and vehicle speed. The driver demand torque values may be determined via operating a vehicle on a chassis dynamometer and adjusting driver demand torque values until desired vehicle performance is achieved. Method 500 proceeds to 504.

At 504, method 500 determines an induction ratio for the engine. In one example, method 500 references a table or a state machine that outputs an induction ratio for the engine based on engine operating conditions. For example, method 500 may index or reference a table based on engine speed and driver demand torque. The table outputs an engine induction ratio (e.g., an actual total number of activated cylinders (e.g., cylinders that are combusting fuel) divided by the actual total number of engine cylinders). The available engine induction ratios may range from 0 to 1 including fractional values (e.g., ½; ¼; ¼; ⅔; etc.) that ensure that the engine may provide the requested driver demand torque. Method 500 proceeds to 506.

At 506, method 500 judges if a particular cylinder that is being evaluated is to be changed from an activated state to a deactivated state for the selected engine induction ratio in the present engine cycle. Method 500 may judge that the particular cylinder being evaluated is to be deactivated for the selected engine induction ratio if the engine induction ratio is being reduced and the cylinder is a cylinder that is deactivated when the engine operates with the selected induction ratio or if the cylinder is to be deactivated for a change in the pattern of cylinders that are to be activated for an engine cycle. For example, an eight cylinder engine having a firing order of 1-3-7-2-6-5-4-8 may change from a first cylinder firing pattern of 1, 3, 2, 6, 4, 8 to a second cylinder firing pattern of 3, 7, 6, 5, 8 in a rolling variable displacement engine mode. As such, if cylinder 1 is being evaluated, then it may be determined as being requested to change from an activated state to a deactivated state for the present engine cycle. If method 500 judges that the cylinder being evaluated is to change from an activated state to a deactivated state in the present engine cycle, the answer is yes and method 500 proceeds to 508. Otherwise, the answer is no and method 500 proceeds to 550.

Alternatively, method 500 may judge if there is a request to increase engine efficiency. The request may be made via a human driver providing input to a human/machine interface. For example, the human driver may request that the vehicle operate in an economy mode. If method 500 judges that there is a request to increase engine efficiency, method 500 proceeds to 520. Otherwise, method 500 proceeds to 512.

In another alternative, method 500 may judge if there is a request to decrease engine oil consumption. The request may be made via a human driver providing input to a human/machine interface. For example, the human driver may request that the vehicle decrease engine oil consumption in an emissions improvement mode. If method 500 judges that there is a request to decrease engine oil consumption, method 500 proceeds to 512. Otherwise, method 500 proceeds to 520.

At 550, method 500 maintains the cylinder being evaluated in its present operating state. Thus, if the cylinder being evaluated is deactivated, then it remains deactivated. Conversely, if the cylinder being evaluated is active, then it remains active. Method 500 proceeds to 514.

At 508, method 500 forecasts an actual total number of consecutive cylinder cycles that the cylinder presently being evaluated is to be deactivated relative to the present engine cycle. If method 500 judges that the cylinder being evaluated is being deactivated as part of entering a fixed or static cylinder deactivation mode, then method 500 may judge that the cylinder presently being evaluated is to be deactivated for more than a threshold number of cylinder cycles. If method 500 judges that the cylinder being evaluated is being deactivated as part of entering a rolling cylinder deactivation mode, then method 500 may judge that the cylinder presently being evaluated is to be deactivated for less than the threshold number of cylinder cycles or more than the threshold number of cylinder cycles, depending on the threshold number and the rolling cylinder deactivation mode.

For example, if the engine is changing from all cylinders being activated to a % induction ratio mode, the present cylinder being evaluated is cylinder number seven, and the engine firing order for the ⅔ induction ratio mode is 1, 3, 2, 6, 4, 8 for a first engine cycle of the mode; 3, 7, 6, 5, 8 for a second engine cycle of the mode; and 1, 7, 2, 5, 4 for a third engine cycle of the mode, the engine firing order repeating thereafter, then it may be determined that cylinder number seven will be deactivated for a single engine cycle before the sequence repeats. Thus, the forecasted actual total number of consecutive cylinder cycles that the cylinder presently being evaluated is to be deactivated is equal to one. Alternatively, method 500 may have values stored in memory for each cylinder for each induction state, and these values may be retrieved from memory to determine the forecasted actual total number of cylinder cycles that the cylinder presently being evaluated will be deactivated. Method 500 proceeds to 510 after the forecasted actual total number of cylinder cycles for the cylinder presently being evaluated is determined.

At 510, method 500 judges if the forecasted actual total number of consecutive cylinder cycles of the cylinder presently being evaluated is greater than a threshold value or number of cylinder cycles. If so, the answer is yes and method 500 proceeds to 512. Otherwise, the answer is no and method 500 proceeds to 520.

At 512, method 500 deactivates the exhaust valve of the cylinder presently being evaluated to begin deactivating the cylinder being evaluated. The intake valves of the cylinder presently being evaluated are deactivated after the exhaust valves are deactivated of the cylinder being deactivated. FIG. 4 shows an example sequence of this procedure where the exhaust valves of a cylinder are deactivated before the intake valves of the cylinder in response to the forecasted actual total number of consecutive cylinder cycles being greater than the threshold value. This procedure may reduce engine oil consumption for conditions where an engine cylinder may be deactivated for more than a threshold number of cylinder cycles (e.g., one cylinder cycle is four strokes of the cylinder). Method 500 proceeds to 514.

At 520, method 500 deactivates the intake valve of the cylinder presently being evaluated to begin deactivating the cylinder being evaluated. The exhaust valves of the cylinder presently being evaluated are deactivated after the intake valves are deactivated of the cylinder being deactivated. FIG. 3 shows an example sequence of this procedure where the intake valves of a cylinder are deactivated before the exhaust valves of the cylinder in response to the forecasted actual total number of consecutive cylinder cycles being less than the threshold value. This procedure may reduce engine pumping work for several engine cycles, thereby improving engine fuel consumption. Method 500 proceeds to 514.

At 514, method 500 judges if the cylinder presently being evaluated is being reactivated in the present engine cycle. If so, the answer is yes and method 500 proceeds to 516. Otherwise, the answer is no and method 500 proceeds to exit.

At 516, method 500 activates the exhaust valve of the cylinder that is presently being evaluated before the intake valves of the cylinder are activated. This procedure is shown in FIG. 3. By opening the exhaust valve before the intake valve, desired exhaust gas scavenging may take place so that a cylinder may have a desired amount of internal exhaust gas recirculation (EGR). Method 500 proceeds to exit. Method 500 may be repeated performed for each engine cylinder during each engine cycle.

Thus, the method of FIG. 5 provides for an engine control method, comprising: deactivating an exhaust valve of a cylinder of an engine during a cylinder cycle before deactivating an intake valve of the cylinder during the cylinder cycle during a first condition; and deactivating the intake valve of the cylinder during the cylinder cycle before deactivating the exhaust valve of the cylinder during the cylinder cycle during a second condition. The method includes where the first condition is a request to increase engine efficiency. The method includes where the second condition is a request to reduce engine oil consumption. The method further comprises operating the engine in a rolling variable displacement mode. The method further comprises operating the engine in a static variable displacement mode. The method further comprises delivering spark to the cylinder within the cylinder cycle after the exhaust valve is deactivated when the exhaust valve is deactivated before the intake valve during the cylinder cycle. The method further comprises not delivering spark to the cylinder within the cylinder cycle after the exhaust valve is deactivated when the exhaust valve is deactivated after the intake valve during the cylinder cycle.

The method of FIG. 5 also provides for an engine control method, comprising: forecasting an actual total number of cycles a cylinder is to be deactivated; deactivating a first valve of the cylinder first in a cylinder cycle when the forecast actual total number of cycles of the cylinder is to be deactivated is greater than a threshold; and deactivating a second valve of the cylinder first in the cylinder cycle when the forecast actual total number of cycles of the cylinder is to be to be deactivated is less than the threshold. The method includes where the forecasting is based on an engine induction ratio. The method includes where the engine induction ratio is based on engine speed and engine load. The method includes where the forecasting is based on a variable displacement engine operating mode. The method includes where the variable displacement engine operating mode is a rolling variable displacement mode. The method includes where the variable displacement engine operating mode is a static variable displacement mode. The method further comprises deactivating the second valve after the first valve during the cylinder cycle when the forecast actual total number of cycles of the cylinder to be deactivated is greater than the threshold. The method further comprises deactivating the first valve after the second valve during the cylinder cycle when the forecast actual total number of cycles of the cylinder to be deactivated is less than the threshold.

In another representation, the method of FIG. 5 provides for an engine control method, comprising: adjusting an order of deactivating intake and exhaust valves of a cylinder responsive to an induction ratio of an engine, the induction ratio based on engine speed and a driver demand torque. The method includes where the intake valves of the cylinder are deactivated during a cylinder cycle before the exhaust valves are deactivated in the cylinder cycle when an engine is entering a rolling variable displacement mode. The method includes where the exhaust valves of the cylinder are deactivated during a cylinder cycle before the intake valves are deactivated in the cylinder cycle when an engine is entering a static variable displacement mode.

Referring now to FIG. 6, plots illustrating engine pumping mean effective pressure that results from cylinder deactivation are shown. The cylinder cycle timing of the first plot and the second plot are the same and the plots are aligned. Further, the scale of the vertical axis are also equal in the two plots.

The first plot from the top of FIG. 6 is a plot of engine pumping mean effective pressure versus cylinder cycles. The vertical axis represents engine pumping mean effective pressure and engine pumping work decreases and fuel efficiency increases the closer trace 602 is to the horizontal axis or the zero level. Trace 602 represents the engine pumping mean effective pressure. The first plot shows conditions when the intake valve is deactivated before the exhaust valve of a cylinder is deactivated in a cycle of a cylinder. Deactivating the intake valve first reduces pressure in the cylinder because exhaust gases are allowed to exit the cylinder before the exhaust valve is deactivated. These conditions lower the in cylinder pressure as indicated by trace 602.

The second plot from the top of FIG. 6 is also a plot of engine pumping mean effective pressure versus cylinder cycles. The vertical axis represents engine pumping mean effective pressure and engine pumping work decreases and fuel efficiency increases the closer trace 604 is to the horizontal axis or the zero level. Trace 604 represents the engine pumping mean effective pressure. The second plot shows conditions when the exhaust valve is deactivated before the intake valve of a cylinder is deactivated in a cycle of a cylinder. Deactivating the exhaust valve first allows pressure to remain in the cylinder because exhaust gases are not allowed to exit the cylinder after a last combustion event in the cylinder occurs after the intake valves are deactivated. These conditions result in high in cylinder pressure as indicated by trace 604 extending away from the horizontal axis.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, at least a portion of the described actions, operations and/or functions may graphically represent code to be programmed into non-transitory memory of the computer readable storage medium in the control system. The control actions may also transform the operating state of one or more sensors or actuators in the physical world when the described actions are carried out by executing the instructions in a system including the various engine hardware components in combination with one or more controllers.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. An engine control method, comprising:

deactivating an exhaust valve of a cylinder of an engine during a cylinder cycle before deactivating an intake valve of the cylinder during the cylinder cycle during a first condition; and deactivating the intake valve of the cylinder during the cylinder cycle before deactivating the exhaust valve of the cylinder during the cylinder cycle during a second condition.

2. The method of claim 1, where the first condition is a request to increase engine efficiency.

3. The method of claim 2, where the second condition is a request to reduce engine oil consumption.

4. The method of claim 1, further comprising operating the engine in a rolling variable displacement mode.

5. The method of claim 1, further comprising operating the engine in a static variable displacement mode.

6. The method of claim 1, further comprising delivering spark to the cylinder within the cylinder cycle after the exhaust valve is deactivated when the exhaust valve is deactivated before the intake valve during the cylinder cycle.

7. The method of claim 1, further comprising not delivering spark to the cylinder within the cylinder cycle after the exhaust valve is deactivated when the exhaust valve is deactivated after the intake valve during the cylinder cycle.

* * * * *